US005621504A

United States Patent [19]

Wakamatsu et al.

[11] Patent Number: 5,621,504

[45] Date of Patent: Apr. 15, 1997

[54] TONER TRANSFERRING DEVICE

[75] Inventors: Kazuhiro Wakamatsu; Akira Sasaki; Nobuaki Fukasawa, all of Hitachi, Japan

[73] Assignee: Hitachi, Ltd., Tokyo, Japan

[21] Appl. No.: 350,565

[22] Filed: Dec. 7, 1994

[30] Foreign Application Priority Data

Dec. 21, 1993 [JP] Japan ..... 5-321556

[51] Int. Cl.[6] ..... G03G 21/00

[52] U.S. Cl. ..... 399/1; 399/33; 399/168; 399/223

[58] Field of Search ..... 355/203, 208, 355/219, 271, 274, 276

[56] References Cited

U.S. PATENT DOCUMENTS

| | | | |
|---|---|---|---|
| 4,699,499 | 10/1987 | Hoshika et al. | 355/274 |
| 5,198,864 | 3/1993 | Fletcher | 355/274 |
| 5,204,730 | 4/1993 | Richmond et al. | 355/274 X |
| 5,298,954 | 3/1994 | Fujita et al. | 355/274 |
| 5,339,144 | 8/1994 | Nakai et al. | 355/274 |

FOREIGN PATENT DOCUMENTS

| | | |
|---|---|---|
| 55-28081A | 2/1980 | Japan . |
| 64-40867A | 2/1989 | Japan . |
| 2-300774A | 12/1990 | Japan . |
| 4-190381A | 7/1992 | Japan . |

*Primary Examiner*—William J. Royer
*Attorney, Agent, or Firm*—Kenyon & Kenyon

[57] ABSTRACT

An apparatus for transferring toner images which is capable of executing optimum discharging control even where the environment, the material of the paper, and the kind of paper may be changed.

First, the load current is detected when the transferring roller 11 is pressed to a transferring drum 6. The detected load current is converted to a characteristics detecting signal S6 at a signal converting section 109. An environment is selected on the basis of the characteristics detecting signal S6. Next, the load current flowing to the transferring roller 11 is detected when an AC discharger 14 is stopped. The detected load current is converted to characteristics detecting signal S6 at the signal converting section 109. A voltage control signal is selected based on the converted characteristics detecting signal S6, the environmental information, and the paper kind. A power source for discharging 22 is controlled by the selected voltage control signal so that the transferring becomes optimum.

Accordingly, even if the kind of paper and environment is changed, optimum transferring and high transferring efficiency can be maintained.

7 Claims, 13 Drawing Sheets

| | | |
|---|---|---|
| X1 → V1 | LOW TEMPERATURE LOW HUMIDITY (L/L) |
| ⋮ ⋮ | ⋮ |
| Xn → V1 | LOW TEMPERATURE LOW HUMIDITY (L/L) |
| X2 → Vn | ROOM TEMPERATURE NORMAL HUMIDITY (N/N) |
| ⋮ ⋮ | ⋮ |
| Xn → Vn | ROOM TEMPERATURE NORMAL HUMIDITY (N/N) |
| X3 → Vh | HIGH TEMPERATURE HIGH HUMIDITY (H/H) |
| ⋮ ⋮ | ⋮ |
| Xn → Vh | HIGH TEMPERATURE HIGH HUMIDITY (H/H) |

FIG. 8

| TRANSCRIPTIONAL VOLTAGE | | | LOADING PERIOD OF ELIMINATING ELECTRICITY |
|---|---|---|---|
| PAPER A | LOW TEMPERATURE LOW HUMIDITY | L1Y → VA1 | TAL |
| PAPER A | LOW TEMPERATURE LOW HUMIDITY | L2Y → VA2 | |
| PAPER A | LOW TEMPERATURE LOW HUMIDITY | L3Y → VA3 | |
| PAPER A | LOW TEMPERATURE LOW HUMIDITY | L4Y → VA4 | |
| PAPER A | ROOM TEMPERATURE NORMAL HUMIDITY | N1Y → VA1 | TAN |
| ⋮ | ⋮ | ⋮ ⋮ | |
| PAPER A | HIGH TEMPERATURE HIGH HUMIDITY | H1Y → HA1 | TAH |
| ⋮ | ⋮ | ⋮ ⋮ | |
| PAPER B | LOW TEMPERATURE LOW HUMIDITY | L1Y → VB1 | TBL |
| PAPER B | LOW TEMPERATURE LOW HUMIDITY | L2Y → VB2 | |
| PAPER B | LOW TEMPERATURE LOW HUMIDITY | L3Y → VB3 | |
| PAPER B | LOW TEMPERATURE LOW HUMIDITY | L4Y → VB4 | |
| PAPER B | ROOM TEMPERATURE NORMAL HUMIDITY | N1Y → VB1 | TBN |
| ⋮ | ⋮ | ⋮ ⋮ | |
| PAPER B | HIGH TEMPERATURE HIGH HUMIDITY | H1Y → HB1 | TBH |
| ⋮ | ⋮ | ⋮ ⋮ | |

TONER TRANSFERRING DEVICE

BACKGROUND OF THE INVENTION

The present invention relates to an electrophotographic printer such as a laser printer and an apparatus for electrophotography such as an electrophotographic copying machine. Specifically, the present invention relates to optimum transfer control of a transferring means for transferring toner images to paper.

Conventionally, a transferring means for transferring toner images in the above described kind of apparatus for electrophotography transfers toner images at a toner image carrier to paper by passing paper as a recording medium through an interval between a transferring roller, whereon a transferring voltage is charged, and the toner image carrier.

Transferring means of the above described type has a problem that transferring performance varies depending on changes in resistant values of the recording medium and transferring rollers in accordance with change in an environmental condition. FIG. 11 is a graph indicating a transferring characteristic relating to humidity which is one of the environmental conditions. A transferring voltage with which an optimum transferring efficiency can be obtained under an environmental condition at room temperature and normal humidity (20° C., 60%) is set, and the transferring efficiency at the transferring voltage is designated as 100%. And, transferring efficiencies which are determined at various humidities such as a low humidity on clear day and a high humidity on rainy day are indicated. The characteristic graph reveals that transferring efficiency decreases remarkably at humidities shifted from the environmental humidity for which the transferring voltage is set.

In consideration of the above problem, conventional transferring means of the above described type prevents the decreasing of the transferring efficiency by detecting resistant values of the recording medium and by controlling the transferring voltage charged to a transferring roller as disclosed in JP-A-55-28081 (1980), JP-A-2-300774 (1990), and JP-A-4-190381 (1992). Further, JP-A-64-40867 (1989) discloses a method wherein a discharging voltage is controlled in accordance with a transferring current which is determined under a condition wherein both the transferring device and the discharger are concurrently operated.

However, currently, a demand for recording to various kinds (such as materials and sizes) of recording media by electrophotographic printers or electrophotographic copiers is increasing, and such a problem has been created that the control in the conventional transferring means can not satisfy the demand sufficiently.

Especially, a transferring defect caused in a case using paper for an over-head projector (OHP) at high temperature and high humidity is one of the problems.

The paper for OHP is processed for anti-static treatment by decreasing surface resistance to prevent the paper from becoming incapable of being feed by mutual electrostatic adhering when the paper is fed from a paper cassette. The above processing causes another problem such as extremely decreasing the transferring efficiency by flowing current from a charging device such as a transferring roller through the paper for OHP to the AC discharger at a high humidity condition and lowering the voltage at transferring points (refer to FIG 12).

Further, a method which uses needle electrodes for discharging electricity on paper without using high AC has the problem that discharging to the needle electrodes causes the lowering of the voltage at the transferring points and thus the transferring efficiency can not be improved.

Furthermore, another method, wherein a discharging voltage is controlled in accordance with a measured transferring current when both a transferring voltage and the discharging voltage are concurrently supplied, has problems that a measured transferring current is influenced by the discharging voltage and results of the measurement can not be obtained exactly, transfer can not be performed stably, and paper-wrapping is caused as a result of insufficient discharging of electricity.

SUMMARY OF THE INVENTION

An object of the present invention is to provide an apparatus for electrophotography having a transferring device capable of maintaining a high transferring efficiency whenever the environmental conditions charge or the kind of recording media is altered.

The above object is realized with an apparatus for electrophotography having a transferring condition measuring means which determines electric characteristics of a transferring means and having a discharging voltage controlling means which controls the discharging means by controlling the voltage and charging time of the discharging means based on the electric characteristics determined by the transferring condition measuring means.

When a toner image is transferred to a sheet of paper, operation of the discharging means is stopped before a top end of the paper reaches at the discharging means to prevent the lowering of the voltage at the transferring points by opening or restricting current circuits from the transferring means to the discharging means. However, intermediate stopping of the discharging process under a low temperature and a low humidity condition causes adhering of the paper to a toner carrier and touching of the paper to a paper guide.

In consideration of the above described problem, the transferring condition measuring means determines electric characteristics of the whole transferring means and paper first under a condition wherein the discharging means does not operate, and the discharging condition is controlled based on the environmental changes, such as temperature and humidity, and the kind of paper, such as material and/or size which are determined previously by the transferring condition measuring means.

Because the AC discharger operates to neutralize the charge of the paper, a voltage at the transferring roller is transferred to the AC discharger through the paper depending on the resistance of the paper. Accordingly, the voltage at the transferring section is lowered and transferring efficiency is decreased. However, the current flowing from the transferring roller, the paper, and the AC discharger to ground can be stopped by terminating operation of the AC discharger, and consequently, optimum transcription wherein a constant voltage is supplied to the paper can be realized. Further, the paper can be separated from the transferring medium smoothly, and preferable transcription with small toner spread can be realized.

DESCRIPTION OF THE DRAWINGS

FIG. 8 is a data table composed in a ROM of the controlling apparatus relating to the present invention.

DETAILED DESCRIPTION

One of the embodiments of the present invention is explained for a laser color printer, an apparatus for color image electrophotography, relating to the present invention.

Figure 10:
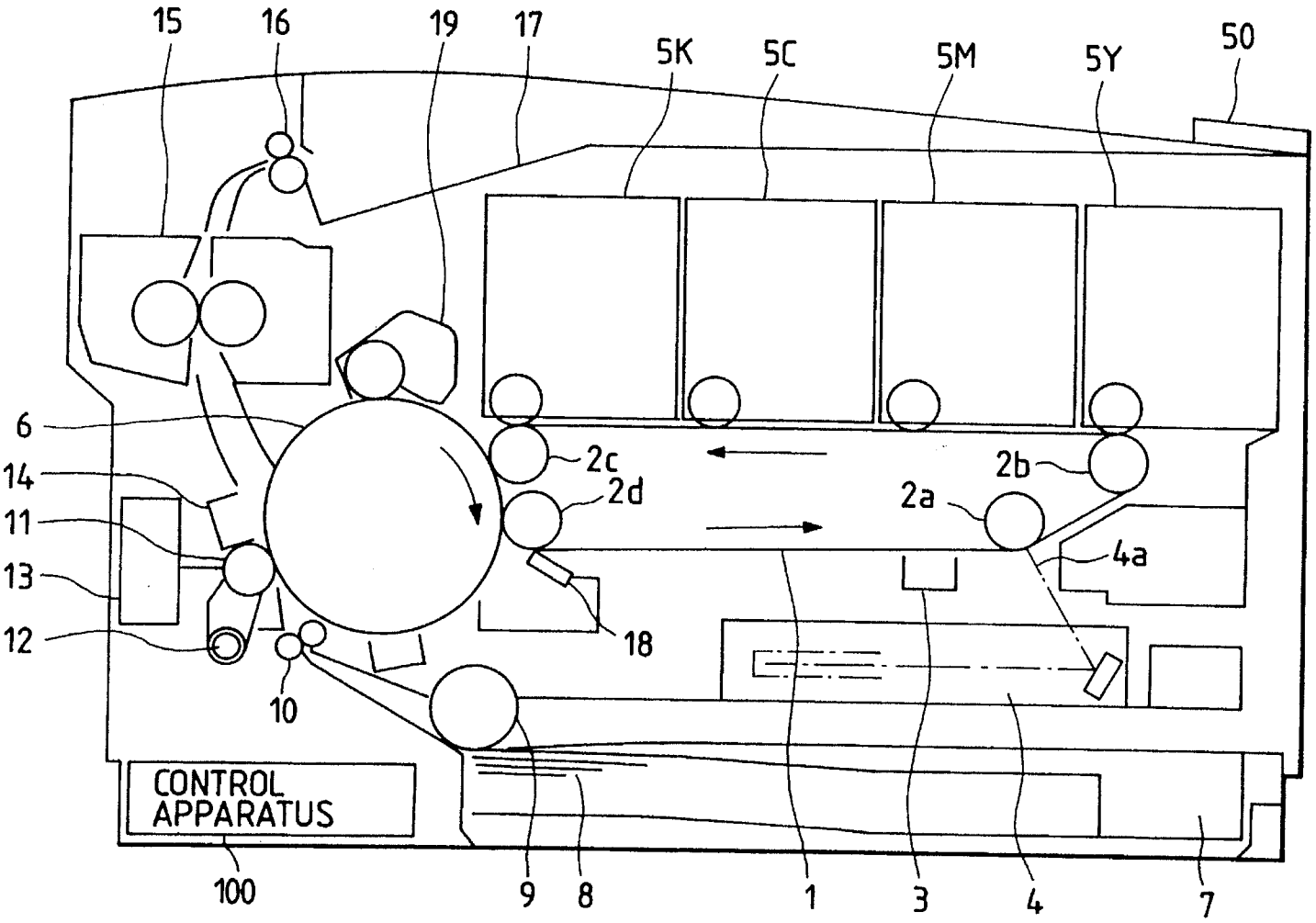
FIG. 10 is a schematic vertical section of a laser color printer relating to the present invention.
Figure 11:
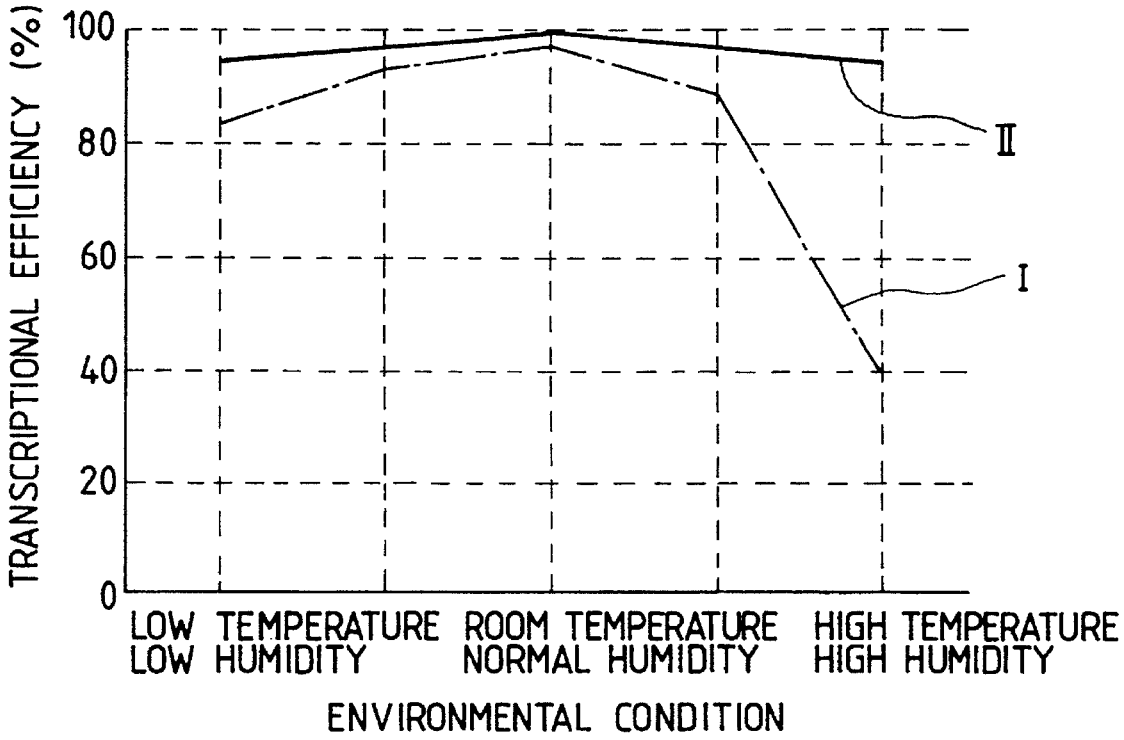
FIG. 11 is a graph indicating transferring characteristics of a transferring roller type transferring means in an apparatus for electrophotography.
Figure 12:
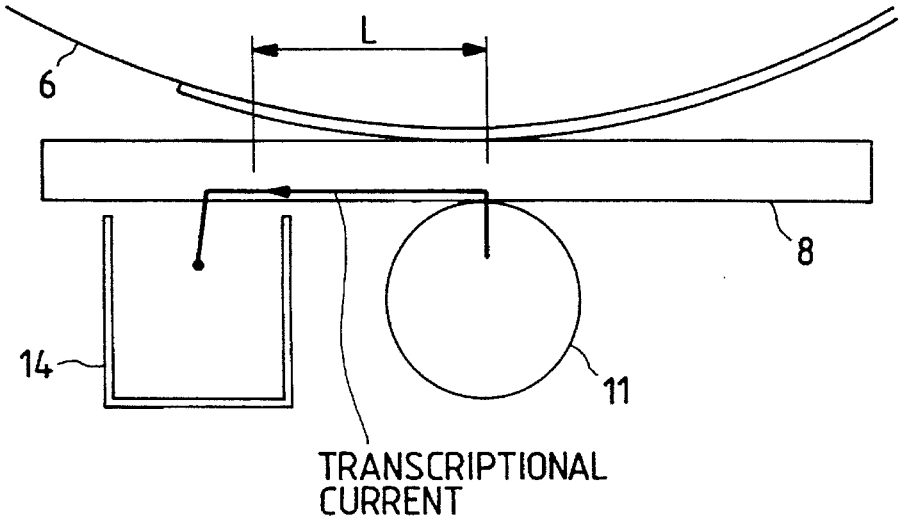
FIG. 12 is an illustration for explaining a reason for transferring failure with a transferring roller type transferring means in an apparatus for electrophotography.

Referring to the drawings, FIG. 10 is a schematic vertical section of the laser color printer relating to the present invention.

An exposing belt 1 rotating at a constant velocity around guide rollers 2*a*–2*d* is charged uniformly by a charger 3. Static latent images corresponding to each color in regular order are formed on the exposing belt 1 (a static latent image corresponding to a color is formed per a rotation of the exposing belt in the present embodiment) by being exposed to laser light 4*a* which is generated from an exposing device 4 in accordance with image signals of each color. Further, toner images of each color are formed on the exposing belt 1 by selecting a development machine using color developer corresponding to one of four development machines 5Y, 5M, 5C, and 5K and by developing the latent images by each development machine in regular order. To ensure precise positioning of the laser light 4*a*, the exposing device 4 is provided to expose the exposing belt 1 with the laser light 4*a* at a position where the guide roller 2*a* is located. The toner image of each color at the surface of the exposing belt 1 is transcribed to surface of a transferring drum 6, which contacts the surface of the exposing belt 1 and rotates synchronously with the exposing belt 1. Thus one by one each of colors are transferred in a superimposing manner to form a color toner image at the surface of the transferring drum 6. The transferring drum 6 has a structure (not shown in FIG. 10) to be supplied with a designated transferring voltage when the toner images at the surface of the exposing belt 1 are transcribed.

Paper 8, recording medium, piled up in a paper cassette 7 is withdrawn and transferred to a resist roller 10 by a paper feed roller 9. After straightening the paper and adjusting the transferring timing of the paper with color toner images at the surface of the transferring drum 6, the paper 8 is transferred to the position of the transferring roller 11.

The transferring roller 11 composing a part of the transferring means transcribes the color toner images at the surface of the transferring drum 6 to the paper by making the transferred paper 8 contact with the transferring drum 6 and applying mechanical pressing force, and by transferring voltage from a face of the paper opposite to the contacting face. The transferring roller 11 is separated from the transferring drum 6 by a transferring roller transferring device 12 so as not to operate while color toner images are being formed at the surface of the transferring drum 6 by transferring toner images of each color at the surface of the exposing belt 1. The transferring roller 11 is transferred by the transferring roller transferring device 12 to contact with the transferring drum 6 at a point of time to transcribe the color toner images to the paper after completing formation of the color toner images at the surface of the transferring drum 6. The transferring voltage supplied to the transferring roller 11 is generated by a power source for transcription 13, which can change the output voltage arbitrarily and continuously, in accordance with a duty ratio of an input signal and the like.

Figure 1:
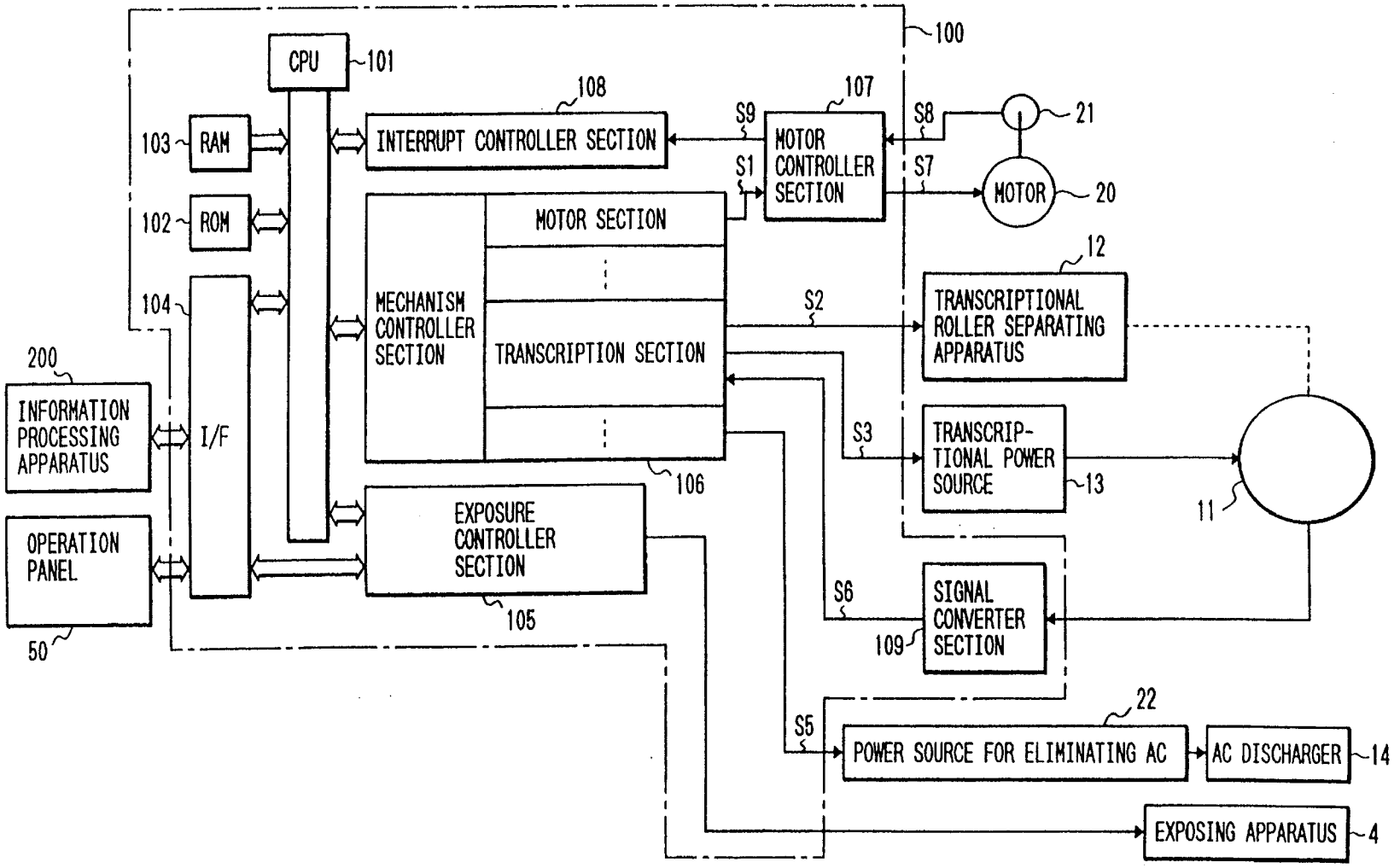
FIG. 1 is a block diagram indicating a control apparatus for a laser color printer relating to the present invention.

An AC discharger 14 generates an AC corona voltage by being supplied with AC voltage from a power source for the AC discharger shown in FIG. 1. The corona voltage eliminates static by neutralizing a residual electric charge remaining at the back face of the paper 8 whereon the color toner images are transcribed so as to facilitate separation of the paper 8 from the transferring drum 6. The paper 8 separated from the transferring drum 6 is sent to a fixing device 15, and the color toner images are fixed thermally at the surface of the paper 8 while the paper 8 passes through the fixing device 15. The paper 8 whereon the color toner images have been thermally fixed are extruded to a paper outlet tray 17 by an extruding roller 16.

A belt cleaner 18 eliminates residual toner remaining at the surface of the exposing belt 1 after transferring toner images formed at the exposing belt 1 to the transferring drum 6. A drum cleaner 19 eliminates residual toner remaining at the surface of the transferring drum 6 after transferring color toner images formed at the surface of the transferring drum 6 to the paper. The drum cleaner 19 is separated from the transferring drum 6 so as not to operate while color toner images are being formed at the surface of the transferring drum 6 by transferring mono-color toner images repeatedly. The drum cleaner 19 is transferred to contact with the transferring drum 6 after transferring the completed color toner images to the paper 8.

A control apparatus 100 controls the above described composing members in accordance with input signals from an operating panel 50 and an information processing apparatus which is explained later.

FIG. 1 is a block diagram indicating details of the control apparatus 100 of the color laser printer. The control apparatus 100 mainly comprises CPU 101, ROM 102 which stores control programs for the CPU 101, and RAM 103 which operates as a work memory necessary for executing the control programs by CPU 101.

An input/output interface (I/F) 104 intermediates communication of the CPU 101 with the operation panel 50 and the information processing apparatus 200 such as a word processor and a personal computer, and transmits printing data generated by the information processing apparatus 200 to an exposure control section 105. The exposure control section 105 generates laser light 4*a* by controlling the exposing apparatus 4.

A mechanism control section 106 comprises a group of controllers for controlling a group of mechanisms of electrophotographical processing, supplies a motor drive instructing signal S1, a transferring roller pressure driving signal S2 which operates the transferring roller separating apparatus 12, transferring pressure controlling signal S3 for controlling generating voltage of the transferring power source 13, and AC discharger controlling signal S5 for controlling operation of the AC discharger 14; and receives characteristics detecting signal S6 including determined electric characteristics of the transferring roller 11 and the others.

A motor control section 107 is composed so as to control a motor 20 which drives the exposing belt 1, the paper feed roller 9, and the fixing device 15 and the others; generates driving signal S7 in accordance with the motor drive instructing signal S1 from the mechanism control section 106; and receives a detecting signal S8 for detecting an amount of angular displacement generated from an encoder 21 which is directly connected to the motor 20. Further, the motor control section 107 transmits the detecting signal S8 from the encoder 21 to the CPU 101 via an interrupt control section 108 as an angular displacement signal S9 for the exposing belt 1. The motor 20 is connected to the guide roller 2*b* of the exposing belt 1 directly, and to the paper feed roller 9 and the fixing device 15 by a gear mechanism via a clutch.

Figure 2:
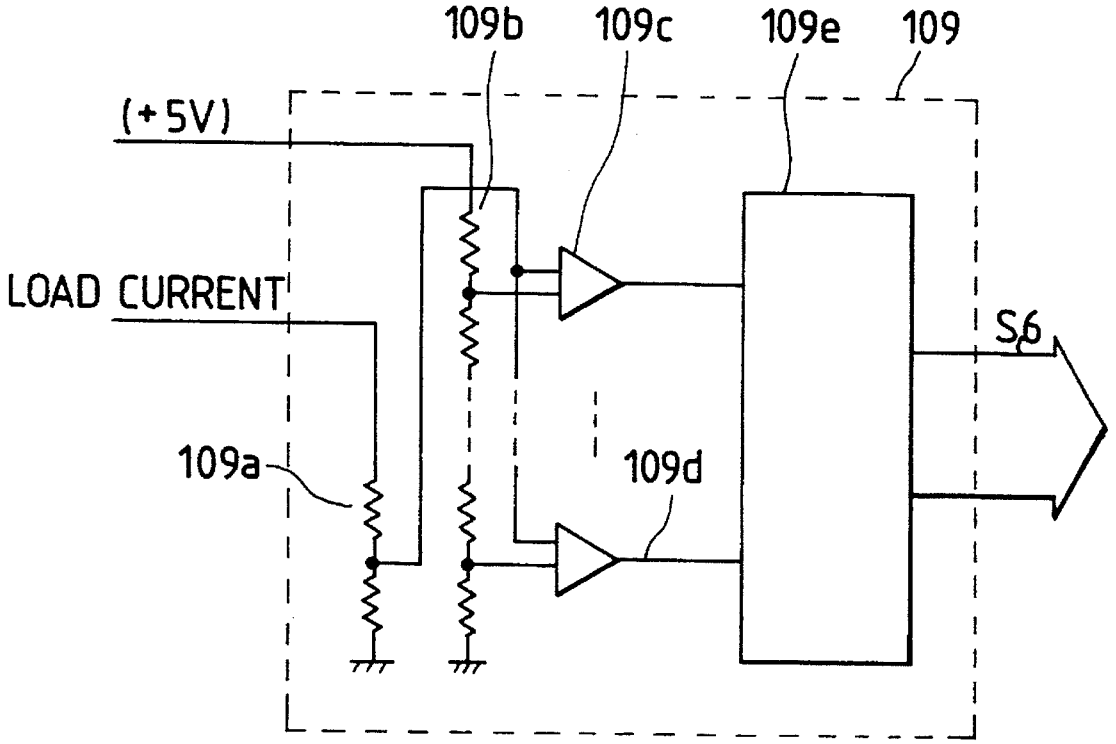
FIG. 2 is a block diagram indicating a signal convertor in a controlling apparatus relating to the present invention.

A signal converter 109 comprises, as shown in FIG. 2, a converting resistor 109*a* which determines the load current flowing through the transferring roller 11 and converts it to a voltage signal, a group of voltage dividing resistors 109*b* for generating a group of standard reference voltages to perform an AD conversion of the above voltage signal, a group of reference comparators 109*c* for supplying converting signal 109*d* by comparing the above voltage signal with the group of standard reference voltages, and a selector 109*e* for supplying characteristics detecting signal S6 of n bits.

The CPU 101 performs a control processing for calculating an optimum transferring voltage by receiving the above characteristics detecting signal S6 via the mechanism control section 106 and making the mechanism control section 106 generate transferring voltage signal S3 for making the transferring power source 13 generate the optimum transferring voltage. Information distinguishing the kind of medium, such as paper standard A/B, can be obtained as an input information supplied by an operator via the operating panel 50. But, an automatic detecting machine for distinguishing kind of paper can be installed at a paper feeding section.

Figure 3:
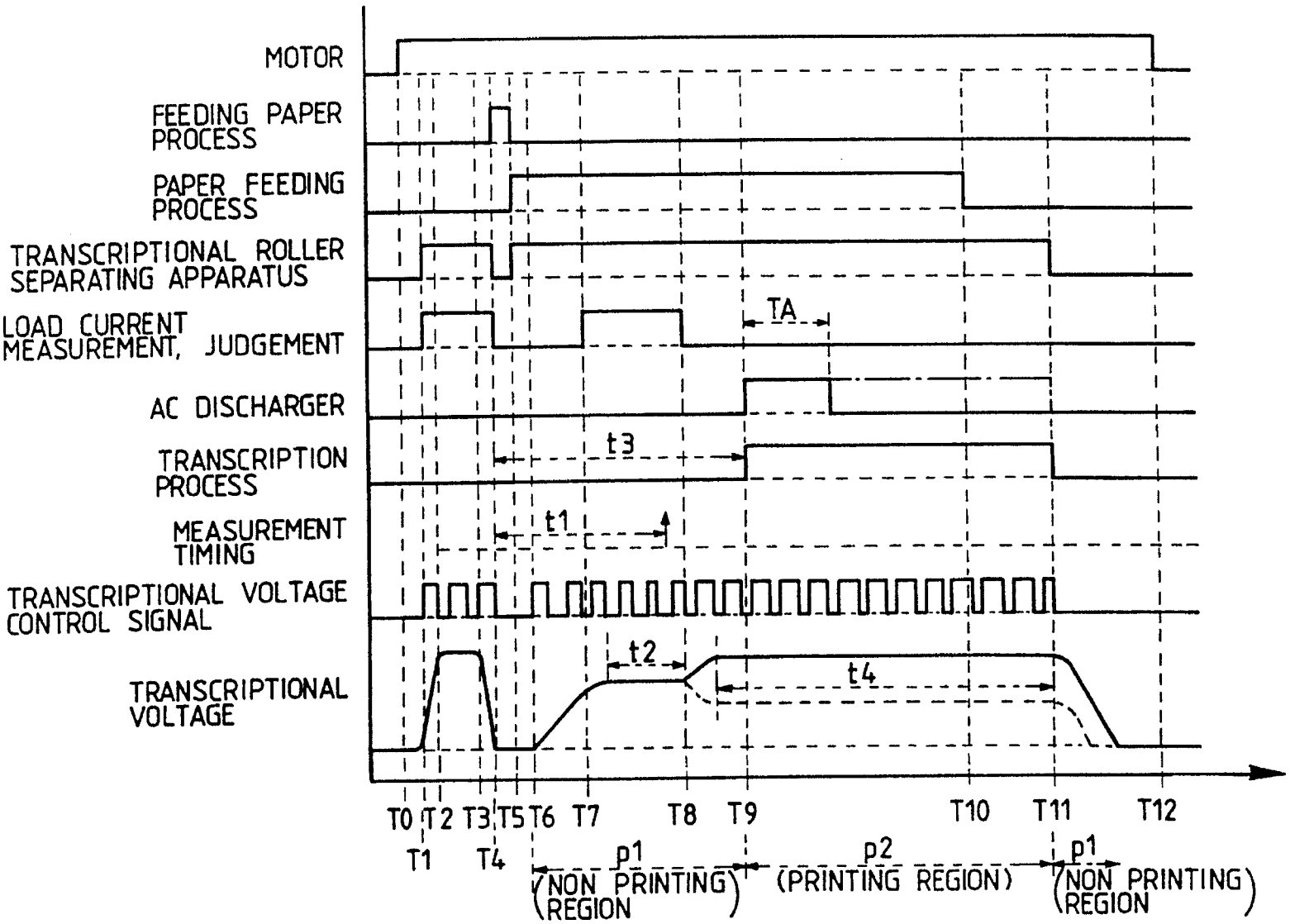
FIG. 3 is a control time chart executed by the controlling apparatus relating to the present invention.
Figure 4:
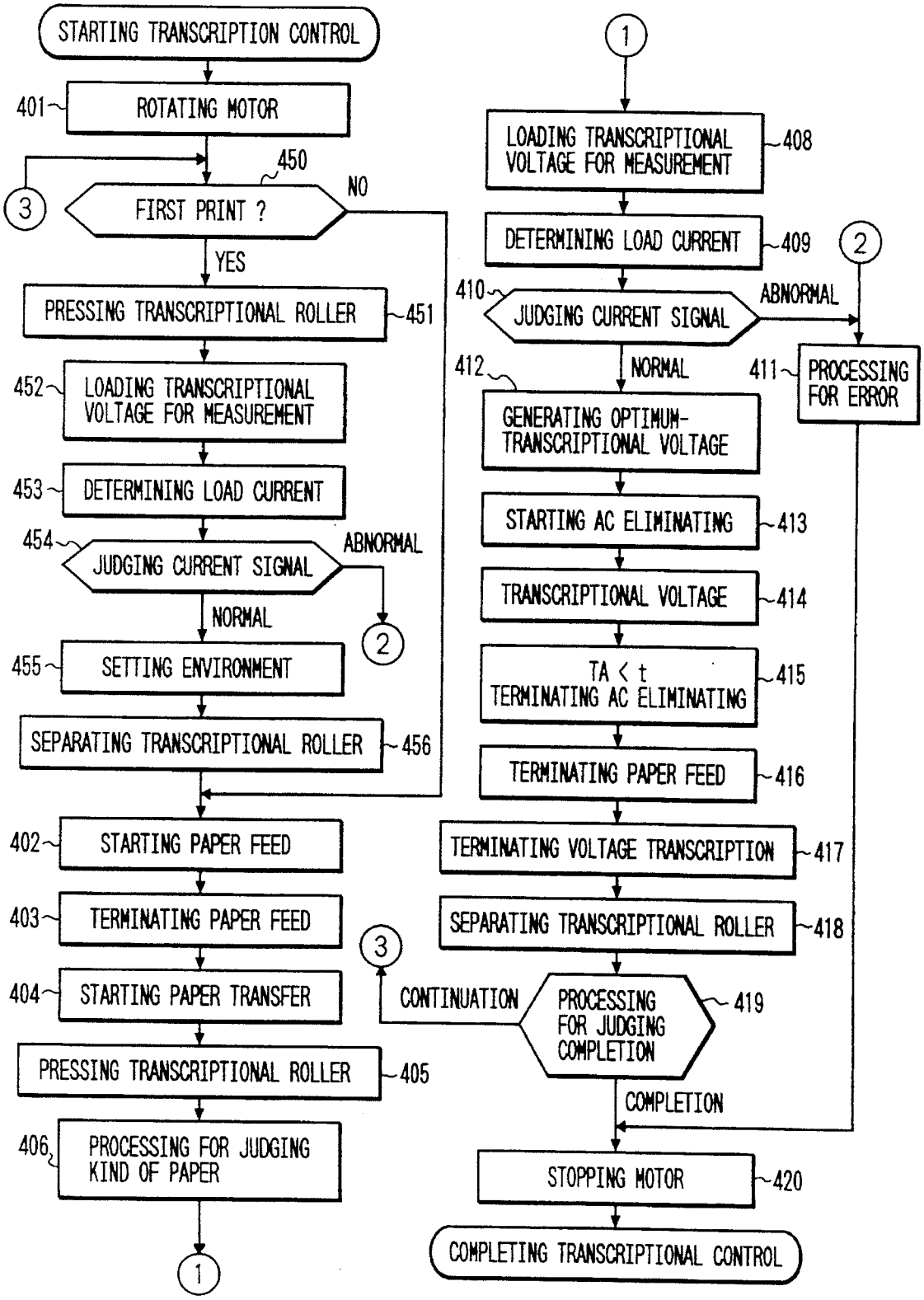
FIG. 4 is a flow chart of a control program executed by the controlling apparatus relating to the present invention.

Referring to FIGS. 3 and 4, a time chart and a flow chart, respectively, control of color toner images transcription to the paper 8 of the above described laser color printer is explained hereinafter.

The control of the transcription starts after the completion of the formation of the color toner images at surface the of the transferring drum 6. At timing TO when the control of the transcription starts, a motor rotating process 401 is performed so as to start operation of the motor by sending the motor drive instructing signal S1 from the mechanism control section 106 to the motor control section 107.

At timing T1, judgement whether printing is for the first page or not is performed at the processing step 450. If the first page case, the step transfers to the transferring roller pressing process 451; if not the first case, the step transfers to the paper feed starting process 402.

In case of the first page, operation of the transferring roller transferring device 12 starts, the transferring roller pressure driving signal S2 is generated at the mechanism control section 106, and the transferring roller pressing process 451 is performed at timing T1.

Further, the charging process of the transferring voltage for measurement 452 for generating the transferring voltage control signal S3 from the mechanism control section 106 is performed so as to supply a transferring voltage for measuring the environment to determine the environmental condition at the moment.

The load current determining process 453 starts at timing T2. The determined load current is converted to characteristics detecting signal S6 by the signal conversion section 109, and then sent to the mechanism control section 106. The load current judging process 454 judges whether the characteristics detecting signal S6 is normal or abnormal, and goes to the process 455 if normal. If abnormal, the processing for error 411 is executed, and subsequently, the motor terminating process 420 which is explained later is performed to complete the transferring control. When the characteristics detecting signal S6 is normal, an environment corresponding to the characteristics detecting signal S6 is selected in accordance with a data table shown in FIG. 5 which is previously stored in the ROM 101 and transferring voltage for measurement, which is explained later, is determined.

Figures 5, 6:
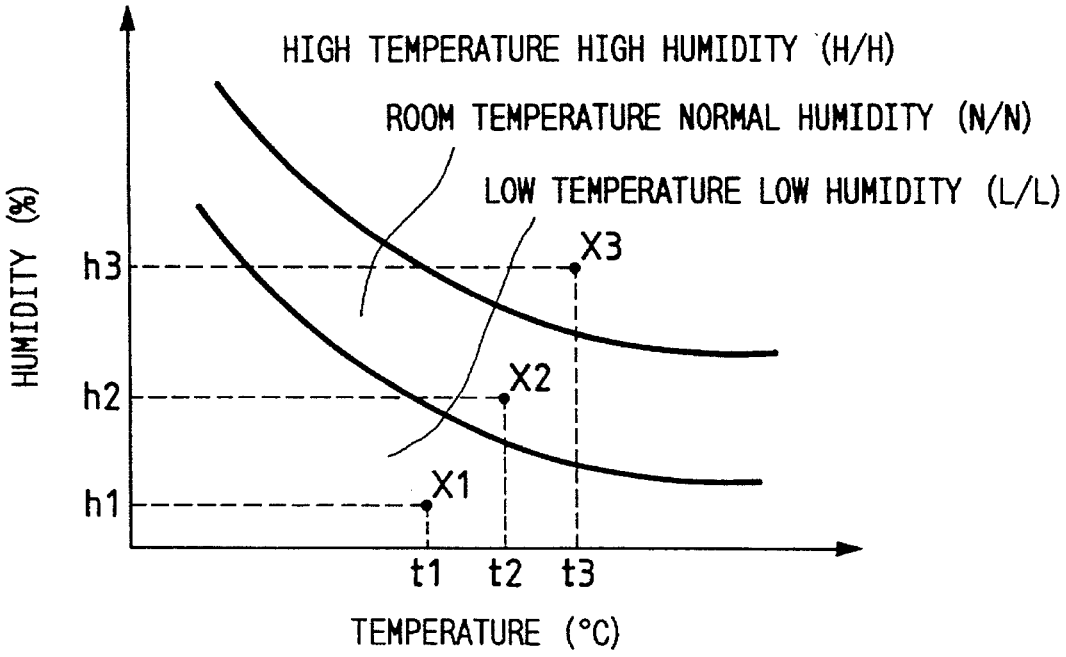
FIG. 5 is a data table composed in a ROM of the controlling apparatus relating to the present invention.
FIG. 6 is a graph indicating characteristics of environment at a transferring means relating to the present invention.
Figure 7:
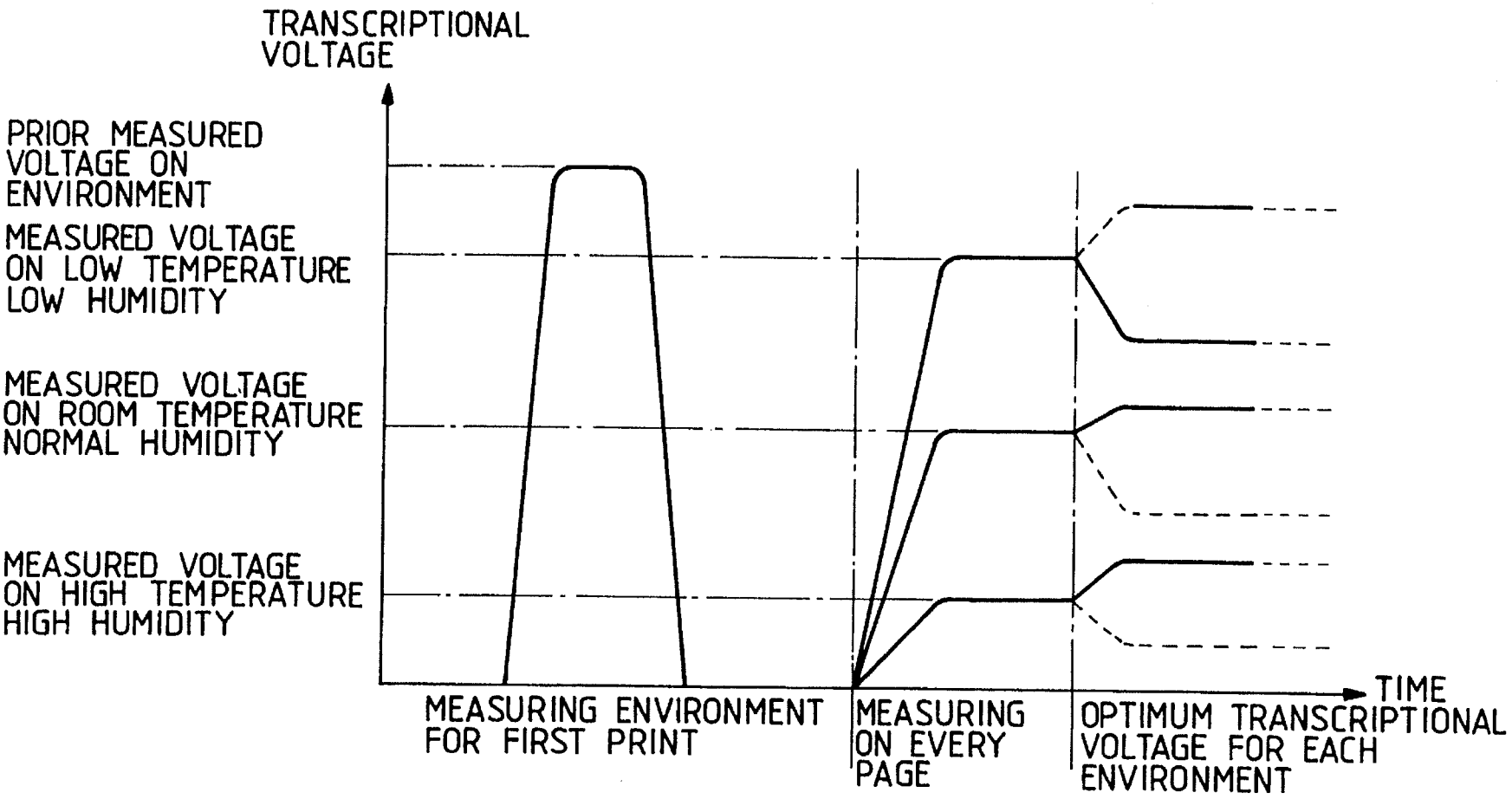
FIG. 7 is a chart indicating characteristics of an optimum transferring voltage at the transferring means relating to the present invention.
Figure 9A:
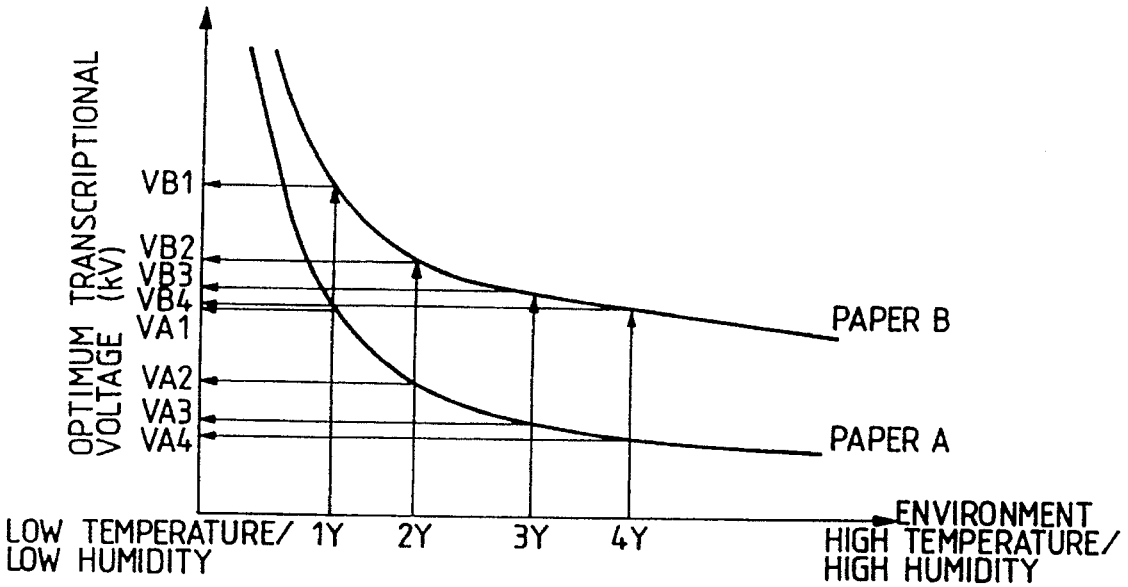
FIGS. 9A and 9B are charts indicating characteristics of an optimum transferring voltage at the transferring means relating to the present invention.
Figure 9B:
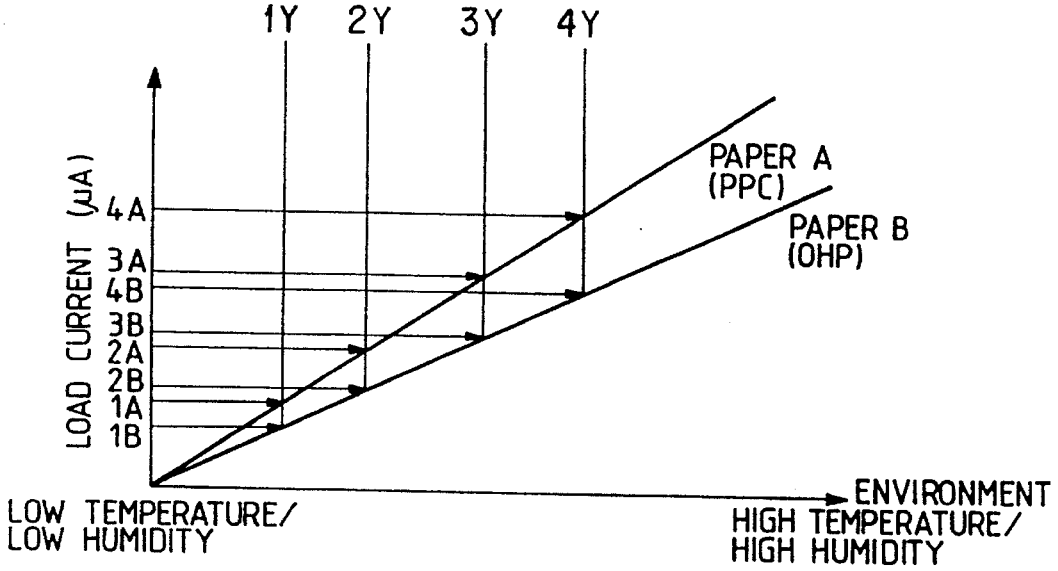

FIG. 6 is a graph indicating environmental characteristics. For instance, when the characteristics detecting signal S6 has a value X1, the environment is judged as low temperature and low humidity by referring to the data table shown in FIG. 5, and the transferring voltage for measurement is decided to be V1. As shown in FIG. 7, the optimum transferring voltage for measurement under an environment varies depending on the environmental condition, and more preferable transferring control can be performed by selecting the environment at the present step.

At timing T3, the transferring roller separating process 456 to separate the transferring roller 11 from the transferring drum 6 is performed.

At timing T4, the paper feed starting process 402 for rotating paper feed roller 9 to pull out a sheet of paper 8 from the paper cassette 7 wherein the paper are piled, and the pulled paper is transferred to the resist roller 10.

At timing T5, paper feeding is stopped at the paper feed terminating process 403, and paper transfer starting process 404 for straightening paper and adjusting transferring timing of the paper with color toner images at the surface of the transferring drum 6 is performed. Further, the transferring roller pressing process 405 is performed for making the mechanism control section 106 generate the transferring roller separation driving signal S2 which operates the transferring roller separating apparatus 12 so that the transferring roller 11 contacts pressingly with the transferring drum 6.

Furthermore, the kind of paper judging process 406 is performed for judging the kind of paper 8 such as PPC paper or OHP paper based on input information set in the operation panel 50 or the detecting signal from the detector.

At timing T6, transferring voltage for measurement loading process 408 is started for making the mechanism control section 106 generate transferring voltage control signal S3 so as to charge the transferring voltage for measuring electric characteristics of the paper 8. The timing is just before a timing when a top end of paper 8 which is transferred from the resist roller reaches at an interval between the transferring drum 6 and the transferring roller 11. At timing T7, the transferring voltage for measurement corresponding to the transferring voltage control signal S3 which is selected at the above described process 455 is supplied to the transferring roller 11.

At timing T6, load current determining process 409 starts. The timing when the load current is determined is a timing later than the paper feed starting process 402 by a fixed time t1, within t2 for stabilizing period of the transferring voltage for measurement, and within p1 which is the non-printing region of the top end portion of the paper 8. The determined load current is converted to the characteristics detecting signal S6 corresponding to the kind of the paper 8 by the signal conversion section 109, and is sent to the mechanism control section 106. At the process 410, the characteristics detecting signal S6 is judged whether it is normal or abnormal, and goes to the process 412 if normal. If abnormal, the processing for error 411 is executed, and subsequently, the motor terminating process 420 which is explained later is performed to complete the transferring control.

When the characteristics detecting signal S6 is normal, the optimum transferring voltage generating process 412 starts at timing T8. At the process 412, data for generating optimum transferring voltage corresponding to the characteristics detecting signal S6 and data for the charging time of the AC discharger are selected from the data table shown in FIG. 8 which is previously stored in the ROM 101. By changing the transferring voltage control signal S3 generated from the mechanism control section 106 based on the data of the optimum transferring voltage, the transferring voltage given from the power source for the transcription 13 to the transferring roller 11 becomes optimum.

FIG. 8 indicates the data table composed in ROM 102. When paper 8 is the paper for PPC, the transferring voltage control signal S3 is prepared by referring to voltage data in various environments for paper in a group A, and charging time for the AC discharger is determined by the charging time data. When paper 8 is the paper for OHP, the transferring voltage control signal S3 is prepared by referring to voltage data in various environments for paper in a group B, and charging time for the AC discharger is determined by the charging time data.

Timing T9 is a timing when transcription of the color toner images starts, the process 413 for making the mechanism control section 106 generate AC discharging control signal S5 which puts the AC discharger in an operating condition is performed, and the transferring managing process 414 is started. In accordance with the above process, the color toner images at the surface of the transferring drum 6 are transcribed to the paper 8. The paper 8 transcribed with the color images is electrically eliminated by AC discharger 14, separated from the transferring drum 6, and sent to the fixing apparatus 15. The color toner images transcription starting timing T9 is a timing later than the paper feed starting process 402 by a fixed time t3, within t4 for stabilizing period of the optimum transferring voltage, and prior of a boundary between the non-printing region and the printing region of the paper 8.

When the transcription starting process is completed, time count starts at the color toner images transcription starting timing T9, and the process 415 which changes AC discharging control signal S5 so as to terminate operation of the AC discharger 14 at a time TA which is obtained from the discharger charging time table is executed.

The time TA is set, when the paper 8 for OHP is used, as a time to reach the AC discharger under a high temperature and high humidity condition, and as a time equivalent to full length of the paper 8 so as to prevent the transferring drum from being adhered with the paper 8 under conditions other than high temperature and high humidity. When the paper for ordinary use is used, the time TA is set as a time equivalent to full length of the paper 8 under all conditions. Therefore, the end of operation of the AC discharger becomes later than timing T10 (the timing for the paper feed terminating process 416) depending on the value of the time TA, and it becomes the same as the timing T11 in some cases.

At timing T10, the paper feed terminating process 416 is executed, and the resist roller 10 is stopped.

The timing T11 is a timing when the transferring of color toner images from the transferring drum 6 to the paper 8 is completed. When the transferring managing process 414 detects the timing T11, the process 417 for changing transferring voltage control signal S3 to terminate generation of the transferring voltage, and the process 418 for changing transferring roller separation driving signal S2 to separate the transferring roller 11 from the transferring drum 6 are performed.

At timing T12, the completion judging process 419 for judging continuation or termination of printing based on a signal from input/output interface 104 is executed, and if the case is continuing the printing, returns to first printing judging process 450 and goes to transcription controlling process for a next page. If the case is terminating the printing, the process 420 for changing the motor drive instructing signal S1 to terminate operation of the motor 20 is performed, and completes the transferring control process.

In accordance with the above described transferring voltage control and AC discharger charging time control, optimum measuring voltage for each environmental condition can be determined based on transferring environment measured at start of printing. And transferring voltage and the AC discharger charging time are determined based on electric characteristics of the paper which is measured with the above optimum measuring voltage. Therefore, a high transferring efficiency can be maintained even if materials of the paper used for a laser color printer are varied such as paper for PPC or paper for OHP.

Further, electric characteristics of the paper 8 are measured by detecting load current flowing through the transferring roller 11 under a condition when operation of the AC discharger 14 is stopped. Therefore, noises in determining very weak load current can be decreased, and accuracy of determination and reliability can be increased.

Figure 13:
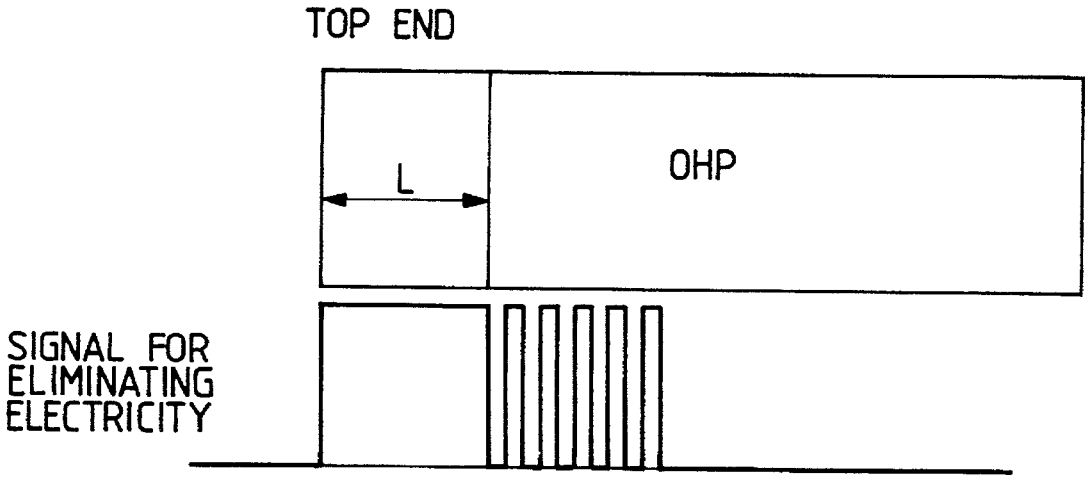
FIG. 13 is a time chart for a pulse control type discharging voltage in another embodiment of the present invention.

Referring to FIG. 13, the second embodiment of the present invention is explained hereinafter.

In the second embodiment, operation of the AC discharger does not stop completely on the middle of the discharge, but repeats on-off of the discharging operation with short cycles for a certain period.

The detecting method for the environmental condition and paper condition is the same as the method in the first embodiment.

By repeating on-off of the discharging operation with short cycles for a certain period, such advantages are realized that rapid change of images caused by changing of the AC discharger operation from on to off can be moderated.

Figure 14:
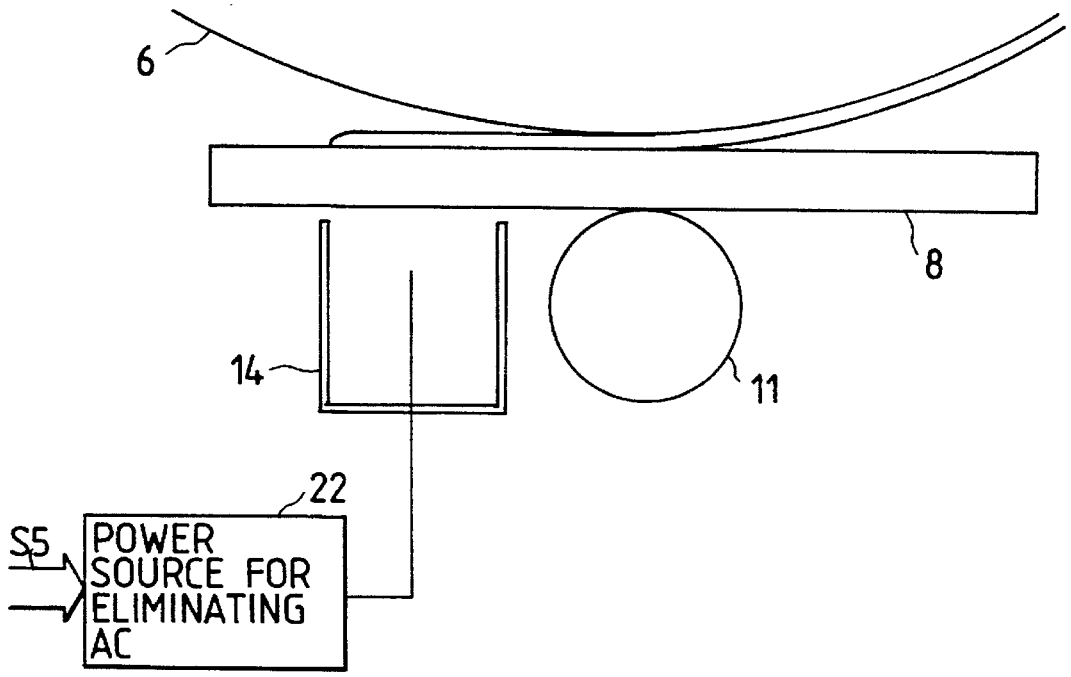
FIG. 14 is a schematic vertical cross section of a discharging voltage control type transferring section and a block diagram for control thereof in another embodiment of the present invention.
Figure 15:
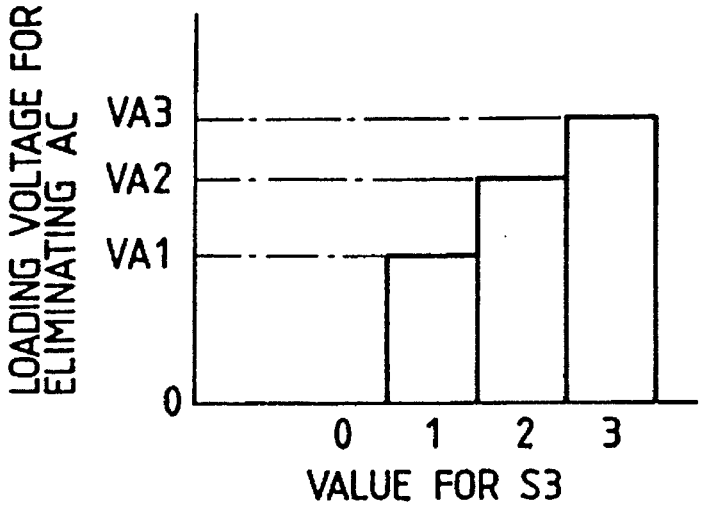
FIG. 15 is a graph indicating characteristics of charged voltage at a discharging voltage control type transferring section in another embodiment of the present invention.

Referring to FIGS. 14 and 15, the third embodiment of the present invention is explained hereinafter.

In the third embodiment, voltage for an AC discharger is controlled depending on the transferring condition and the kind of paper by providing a power source for AC discharger 22 which can control voltage of the AC discharger at plural steps (three steps in the present embodiment) and by storing a data table for voltage control in the ROM 102.

The detecting method for the environmental condition and paper condition is the same as the method in the first embodiment.

By controlling the voltage for the AC discharger at plural steps, uniform discharge through the paper becomes possible and advantages such that decreasing of fluctuation of images at printing plane can be realized.

Figure 16:
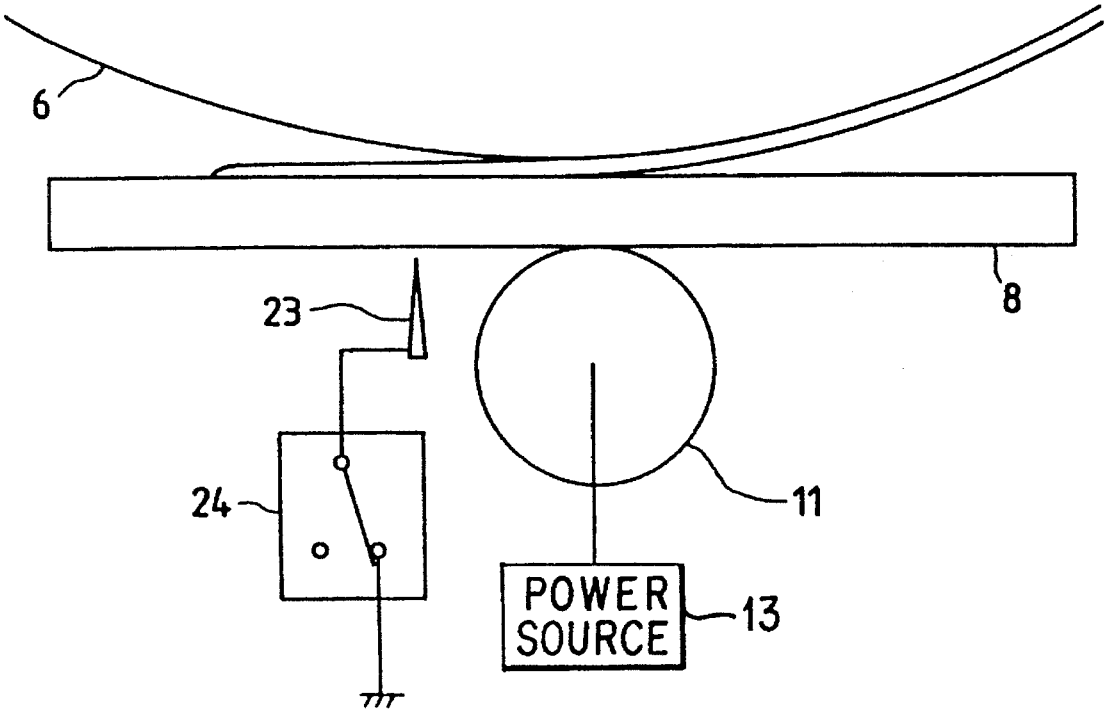
FIG. 16 is a schematic vertical cross section of a needle shaped discharger and a block diagram for control thereof in another embodiment of the present invention.
Figure 17:
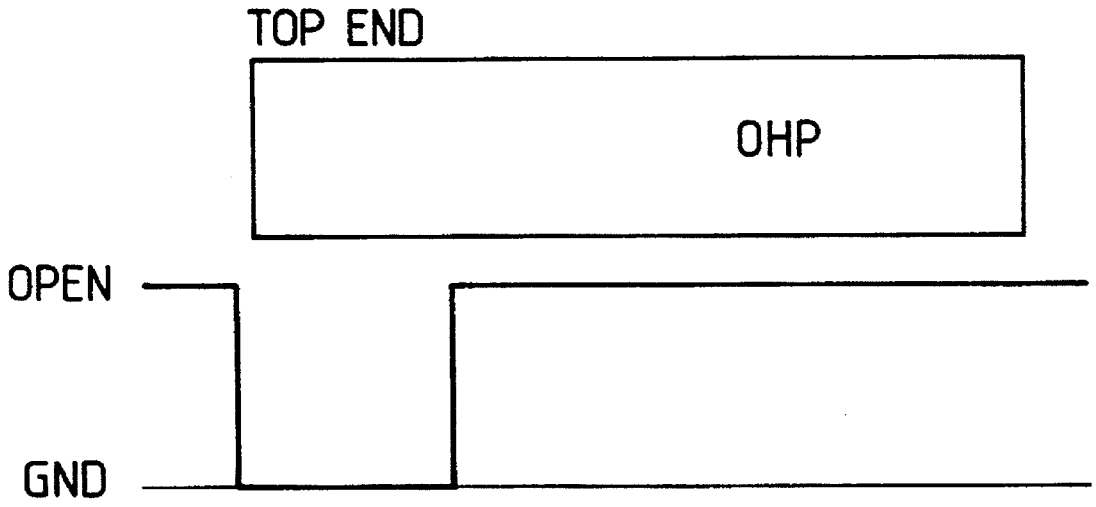
FIG. 17 is a graph indicating control of a needle shaped discharger in another embodiment of the present invention.

Referring to FIGS. 16 and 17, the fourth embodiment of the present invention is explained hereinafter.

In the fourth embodiment, a needle type electrode 23 is provided instead of the AC discharger 14, and discharge can be performed by discharging operation of the transcribed paper 8 to the needle type electrode 23.

A switching circuit 24 such as relays is connected to the needle type electrode 23. The needle type electrode can be connected to ground in accordance with the signal S5 from the control apparatus 100.

The detecting method for the environmental condition and paper condition is the same as the method in the first embodiment.

When transferring images at surface of the transferring drum 6, the needle type electrode 23 is connected to ground first. Therefore, discharge is caused at the top end of the paper 8, and the discharged paper is separated from the transferring drum 6. Subsequently, after a time TA which is designated based on an environmental condition, the needle type electrode 23 is disconnected from ground, and the discharge is stopped. Accordingly, the flowing current from the transferring roller 11 to ground via the paper 8 and the needle type electrode is interrupted, and a voltage is charged to the paper.

In accordance with the present embodiment, use of a power source for AC high voltage can be avoided by using the needle type electrode, and advantages such as no ozone generation are realized.

In the above embodiments, explanations were performed regarding to a transferring type wherein a transferring drum 6 was provided and a color toner image was formed by overlapping toner of each color at the surface of the transferring drum 6. However, the present invention can naturally be applied to another transferring type such as a type wherein the transferring drum is not provided, but the color toner image is formed at the surface of a photosensitive body (photosensitive belt or photosensitive drum) and the formed color toner image is transferred to paper. Further, a transferring belt can be used instead of the transferring drum.

The present invention was explained above taking a color printer for an example, but the present invention can naturally be applied to general mono-color printers and copying machines by using appropriate sensors for temperature and humidity, and by controlling the AC discharger.

A means for controlling the discharger can change discharging control characteristics which is based on measured electric characteristics of the paper depending on a change of environmental condition and the kind of the paper (material and/or size). Therefore, even if papers of various materials such as PPC paper or OHP paper and/or of various sizes are used, optimum discharging for the used paper can be performed, and a high transferring efficiency can be maintained regardless of the material and size of the paper.

Further, measurement of electric characteristics of the paper is performed by detecting load current flowing through the transferring roller in a condition when the AC discharger stopped. Therefore, noises in determining very weak load current can be decreased, and the accuracy of the determination and reliability can be increased.

What is claimed is:

1. An apparatus for electrophotography comprising:

a toner image carrier;

a toner image preparer forming a toner image on the rotating toner image carrier;

a recording medium carrier carrying a recording medium whereon the toner image formed on the toner image carrier is to be transferred;

a transferring roller transferring the toner image on the toner image carrier to the recording medium a discharger neutralizing charged electricity at the recording medium; and a fixing device fixing the toner image on the recording medium, having:

a transferring condition measuring device measuring electric characteristics of said transferring roller; and a discharging voltage controller controlling said discharger;

wherein said transferring condition measuring device measures the transferring condition when said discharger is stopped; and said discharging voltage controller controls said discharger based on an output from said transferring condition measuring device.

2. The apparatus for electrophotography of claim 1, wherein a discharging voltage is controlled so as to stop before reaching a top end of the recording medium at said discharger.

3. The apparatus for electrophotography of claim 1, wherein a discharging time of said discharger is altered depending on change of at least one of temperature and humidity.

4. The apparatus for electrophotography of claim 1, wherein a discharging voltage of said discharger is altered depending on change of at least one of temperature and humidity.

5. The apparatus for electrophotography of claim 1, wherein said discharger has a needle shaped electrode.

6. An apparatus for electrophotography comprising:

a charger charging a uniformly rotating photosensitive body;

an exposing device forming a static latent image by exposing the charged photosensitive body with respective colors, of light based on printing information;

a plurality of developing machines developing said static latent image to a toner image with a toner, provided for each of the respective colors;

an intermediate transferring body forming a color toner image by transferring the toner image formed on the photosensitive body for each of the respective colors;

a recording medium carrier carrying a recording medium whereon the color toner image formed on said intermediate transferring body is to be transferred;

a transferring roller transferring the color toner image on said intermediate transferring body to the recording medium;

a discharger neutralizing charged electricity at the recording medium; and a fixing device fixing the color toner image on the recording medium, having:

a transferring condition measuring device measuring electric characteristics of said transferring roller; and a discharging voltage controller controlling said discharger;

said transferring condition measuring device measures the transferring condition in a condition that said discharger is stopped; and said discharging voltage controller controls said discharger based on an output from said transferring condition measuring device.

7. The apparatus for electrophotography of claim 6, wherein a discharging voltage is controlled so as to stop before reaching a top end of the recording medium at said discharger.

* * * * *